US005644927A

United States Patent [19]

Tatematsu et al.

[11] Patent Number: 5,644,927

[45] Date of Patent: Jul. 8, 1997

[54] AUGER-TYPE ICE MAKING MACHINE

[75] Inventors: Susumu Tatematsu, Nagoya; Yasumitsu Tsukiyama, Toyoake; Noboru Watanabe, Nagoya; Hideyuki Ikari, Kariya, all of Japan

[73] Assignee: Hoshizaki Denki Kabushiki Kaisha, Toyoaki, Japan

[21] Appl. No.: 408,490

[22] Filed: Mar. 22, 1995

[30] Foreign Application Priority Data

Mar. 23, 1994 [JP] Japan ..... 6-052183

[51] Int. Cl.[6] ..... F25C 1/14

[52] U.S. Cl. ..... 62/354

[58] Field of Search ..... 62/354; 165/94

[56] References Cited

U.S. PATENT DOCUMENTS 3,756,041 9/1973 Hanson ..... 62/354
3,910,060 10/1975 Beusch ..... 62/354
4,250,718 2/1981 Brantley ..... 62/354
5,189,891 3/1993 Sakamoto ..... 62/354

*Primary Examiner*—William E. Tapolcai
*Attorney, Agent, or Firm*—Wenderoth, Lind & Ponack

[57] ABSTRACT

An auger-type ice making machine includes an ice making barrel, an auger provided in the ice making barrel, an upper bearing and a lower bearing which are provided inside the ice making barrel for supporting the auger rotatably, and a drive unit for rotating the auger. At the bottom end of the ice making barrel, a connecting flange extending outwardly in the radial direction is formed integrally with the ice making barrel by friction welding. The connecting flange is tightened to the top surface of a casing of the drive unit with bolts. A bearing housing of the lower bearing is fixed in the ice making barrel apart from the casing with a bolt which is screwed in the ice making barrel. The bearing housing of the lower bearing may alternatively be fixed by forming an outward flange and a plurality of projections extending outwardly at the bottom end of the bearing housing and by fitting the plurality of projections in a fitting groove of the casing of the drive unit.

10 Claims, 9 Drawing Sheets

AUGER-TYPE ICE MAKING MACHINE

BACKGROUND OF THE INVENTION

1. Field of the Invention

The present invention relates to an auger-type ice making machine and, more particularly, to a support structure of a lower bearing which is provided in a lower end section of an ice making barrel thereof.

2. Description of the Related Art

An auger-type ice making machine is a continuous ice making machine which is designed to rotate an auger in a vertical ice making barrel, scrape the ice which freezes and grows on the inner surface of the ice making barrel, and feed it out upwardly. A typical example of such auger-type ice making machine will be described with reference to FIG. 12. An auger 3 is supported, via bearings 5*a* and 5*b*, in a cylindrical ice making barrel 1 around which a refrigerant evaporating pipe 1*a* is wound. The upper bearing 5*a* is fixed onto the upper end section of the ice making barrel 1 via a pressing head 7, and the lower bearing 5*b* is fixed onto the lower end section of the ice making barrel 1 via a bearing housing 9. The bearing housing 9 is fixed with a flange onto a casing 11*a* of a drive unit which includes a drive motor 11. The auger 3 is linked to an output shaft of the drive motor 11 and is rotated to scrape the ice which freezes and grows on the inner surface of the ice making barrel 1 and feed it upwardly, thereby producing predetermined ice chips. The structure stated above has been used extensively as seen from the disclosure in Japanese Utility Model Laid-Open Nos. 62-45656 and 57-85169, Japanese Patent Laid-Open No. 58-21020, etc.

The conventional general structure described above is structurally advantageous in that the auger is axially centrally aligned with the output shaft of the drive unit to form a good shaft coupling free from eccentricity, since the bearing housing which supports the lower bearing of the auger is directly fixed onto the casing of the drive unit. This structure, however, is disadvantageous in achieving the best possible alignment or the like between the ice making barrel and the auger.

To be more specific, the first consideration is that the ice making barrel 1 with the evaporating pipe 1*a* wrapped therearound serves as a functional member which provides the inner peripheral surface thereof as an ice making surface and it also serves as a structural reinforcing member. As such structural member, it should have a thick wall to offer high rigidity and strength. On the other hand, however, the wall should be made as thin as possible to control the resistance of heat transfer to a minimum so as to improve the ice making capability. Hence, the ice making barrel is designed with a wall thickness that is a compromise attempting to satisfy the above two conflicting requirements at a practical level.

Secondly, in order to efficiently freeze and grow ice on the inner peripheral surface, i.e. the ice making surface, of the ice making barrel, it is required to set the distance (gap) between the spiral blade of the auger and the inner peripheral surface of the ice making barrel to an optimal value within a relatively small range. In addition, the wear on the bearings must also be taken into account. Failure to give careful consideration to these two points would cause the spiral blade to come too close to the inner surface of the ice making barrel, resulting in a shortened service life. The optimal gap based on such consideration ranges from 0.4 to 0.5 mm, for example, although it varies depending on conditions. As mentioned above, the structure wherein the ice making barrel is linked to the drive motor through the bearing housing is not entirely satisfactory because it incurs accumulated errors (manufacturing tolerance) of the constitient members. A possible solution to the problem of the accumulated manufacturing tolerances is to raise the grade of the manufacturing tolerances of the individual components included. This type of solution, however, unavoidably involves increased manufacturing cost in machining.

Further, as previously described, this type of ice making machine is designed to scrape a layer of ice, which has grown on the inner peripheral surface of the ice making barrel, and feed the scraped ice upwardly to compress and solidify the ice through the pressing head. This means that the ice making barrel is subjected to a heavy upward load. The load is transmitted to a bearing housing through bolts, which fix the bearing housing to the ice making barrel, and the load is transmitted further to the drive motor. At this time, the load is not always distributed evenly to a plurality of through bolts, causing the axial center of the ice making barrel to relatively tilt in relation to the axial center of the bearing housing and the axial center of the auger, thus changing the aforesaid gap. This prevents good ice making conditions from being obtained and it may also lead to a markedly shortened service life of the machine.

SUMMARY OF THE INVENTION

Accordingly, an object of the present invention is to provide an auger-type ice making machine which is capable of always maintaining an optimal gap between the inner peripheral surface of an ice making barrel thereof and the spiral blade of the auger over a predetermined period of service life, thus enabling satisfactory ice making operation.

To this end, the auger-type ice making machine according to the present invention comprises: an ice making barrel which is provided vertically, an auger which is disposed coaxially in the ice making barrel, an upper bearing and lower bearing which are provided in the upper and lower sections of the ice making barrel, respectively, for supporting the auger rotatably, a drive unit connected to the bottom end section of the auger for rotating the auger, a casing which covers the drive unit, and a connecting flange which is formed to extend outwardly in the radial direction at the bottom end of the ice making barrel and which is tightened onto the top surface of the casing with bolts.

The connecting flange can be formed integrally with the ice making barrel by friction welding. The bearing housing of the lower bearing which is provided in the lower section of the ice making barrel may either be fixed onto the ice making barrel by spacing it apart from the casing of the drive unit and by using a bolt screwed through the ice making barrel or fixed by forming an outward projection at the extended bottom end thereof and fitting the outward projection in a fitting groove in the casing of the drive unit.

In the structure stated above, the ice making barrel is directly fixed onto the casing of the drive unit via the connecting flange which is integrally formed, enabling the ice making barrel to be positioned coaxially with the output shaft and the auger with high accuracy. Furthermore, a major manufacturing tolerance which influences the amount of the gap between the inner surface of the ice making barrel and the spiral blade of the auger depends only on the level of the manufacturing accuracy of the ice making barrel and the auger. Thus, the assembly tolerance is lower than that in the conventional structure because the machining tolerance of the lower bearing housing is no longer involved. Therefore, the gap between the inner surface of the ice making barrel and the spiral blade of the auger can be maintained within an ideal range.

In addition, the upward load which is applied to the ice making barrel works as a tensile load applied to the bolts which tighten the connecting flange to the casing of the drive unit. This minimizes the deformation or displacement of the bolts and prevent an uneven load from being applied to the plurality of bolts, thus maintaining an ideal coaxial relationship between the axial center of the lower bearing and the axial center of the ice making barrel.

Further, the ice making barrel is directly fixed on the casing of the drive unit and therefore the load generated mainly from the scraping and transferring of the ice by the auger, and the compression and dehydration carried out in the pressing head is borne by the ice making barrel. Hence, a minimum of load is applied to the lower bearing housing which is fixed in the ice making barrel. This permits the use of a plastic-molded lower bearing housing.

DESCRIPTION OF THE PREFERRED EMBODIMENTS

Figure 1:
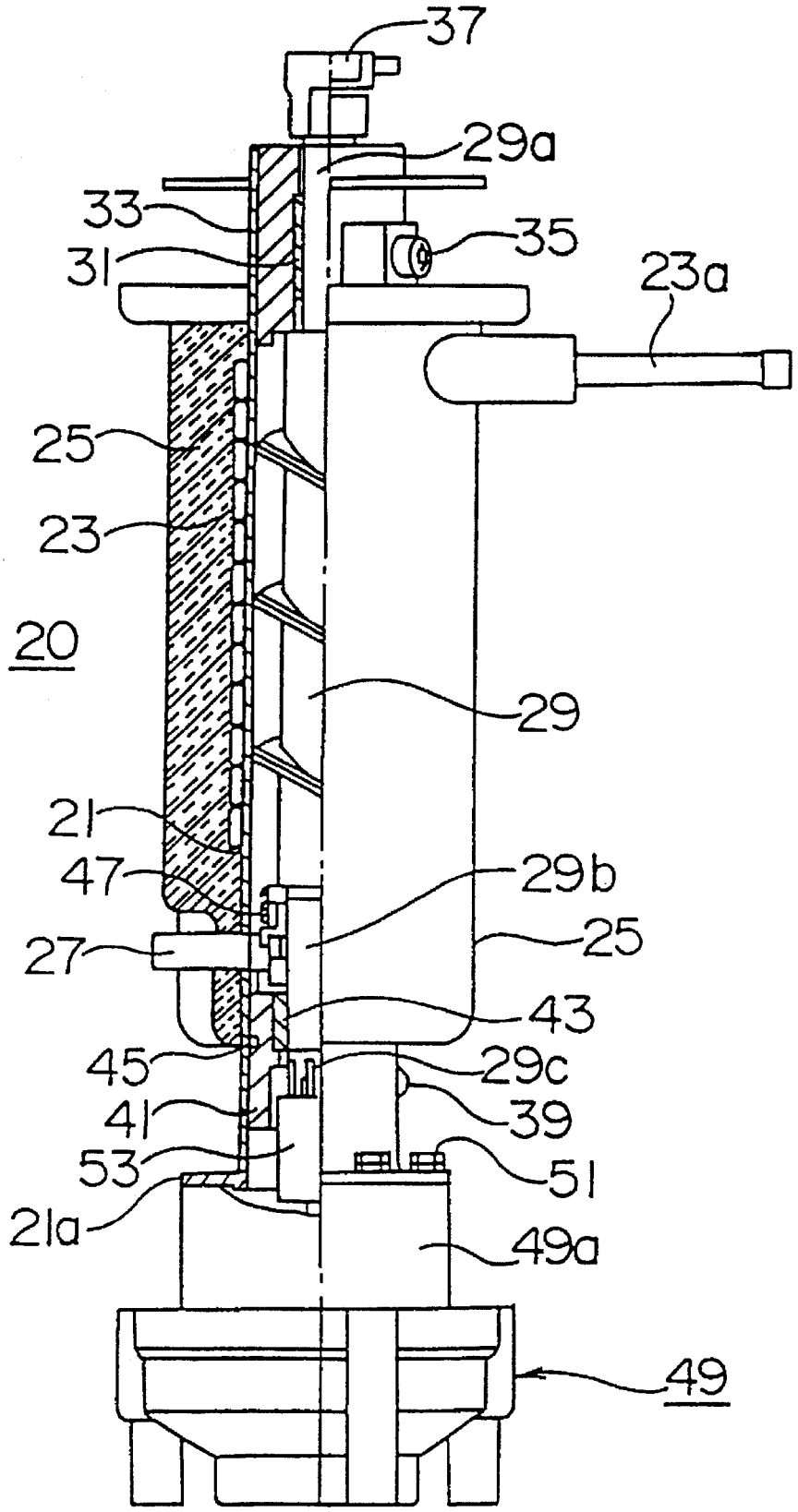
FIG. 1 is a partially cutaway front view showing an essential part of an auger-type ice making machine according to a first embodiment of the present invention.

A detailed description of preferred embodiments of the present invention will be given with reference to the accompanying drawings. In the drawings, identical reference numerals denote identical or equivalent parts.

In FIG. 1, a comprehensive view of the ice making mechanism section of the auger-type ice making machine according to the first embodiment of the present invention is given by a reference numeral 20. An ice making barrel 21 has a flange provided at the bottom thereof as it will be discussed later. Barrel 21 is generally a cylinder which extends vertically, and it has a refrigerant evaporating pipe 23 wound around the outside thereof. One end 23*a* of the refrigerant evaporating pipe 23 is communicated with a refrigerating system which is not illustrated. The refrigerant evaporating pipe 23 is mostly enclosed with a heat insulator 25. The condensed refrigerant sent from the refrigerating system takes heat from the ice making barrel 21 and also from the inside thereof and evaporates. An ice making water supply port 27 communicated to a water supply tank, which is not illustrated, is communicated with the bottom section of the ice making barrel 21 go as to supply the ice making water which is to be cooled by the aforesaid refrigerant to produce ice.

An upper shaft 29*a* of an auger 29, which is disposed coaxially in the ice making barrel 21, is supported rotatably by a pressing head 33 via an appropriate cylindrical bearing 31 in the upper section of the ice making barrel 21. The pressing head 33, which has an ice compressing passage (not illustrated) as widely known, is fixed onto the ice making barrel 21 by a plurality of fixing bolts 35 which are disposed at intervals around the circumference of the upper section of the ice making barrel 21. The distal end of the upper shaft 29*a* is equipped with a cutter 37. Ice in a column shape, which has passed through the ice compressing passage of the pressing head 33, is cut or broken by the cutter 37.

A cylindrical lower bearing 43 is fitted into a bearing housing 41 which is fixed in the bottom end section of the ice making barrel 21 by a plurality of bolts 39. The lower bearing 43 supports a lower shaft 29*b* of the auger 29 and allows it to rotate. An O-ring 45 is fitted in an outer peripheral groove which is located almost at the axial center of the bearing housing. The O-ring 45 seals the outer peripheral surface of the bearing housing 41 in cooperation with the inner surface of the ice making barrel 21. The base of the lower shaft 29*b* has a mechanical seal 47 which is provided above the lower bearing 43, the details of which are not illustrated since it is well known structure. The mechanical seal 47 seals the inner peripheral surface of the bearing housing 41 and around the lower bearing 43 against leakage.

As it will be discussed later, a connecting flange 21*a*, which is formed integrally with the bottom end of the ice making barrel 21, extends outwardly in the radial direction and is fixed onto the top surface of a casing 49*a* of a drive motor, namely, a geared motor 49, with a plurality of flange bolts 51. A spline section 29*c*, which is formed in the axial direction at the end of the lower shaft 29*b* of the auger 29, is connected to an output shaft 49*b* (refer to FIG. 3) of the geared motor 49 through a widely-known spline joint 53.

Figure 3:
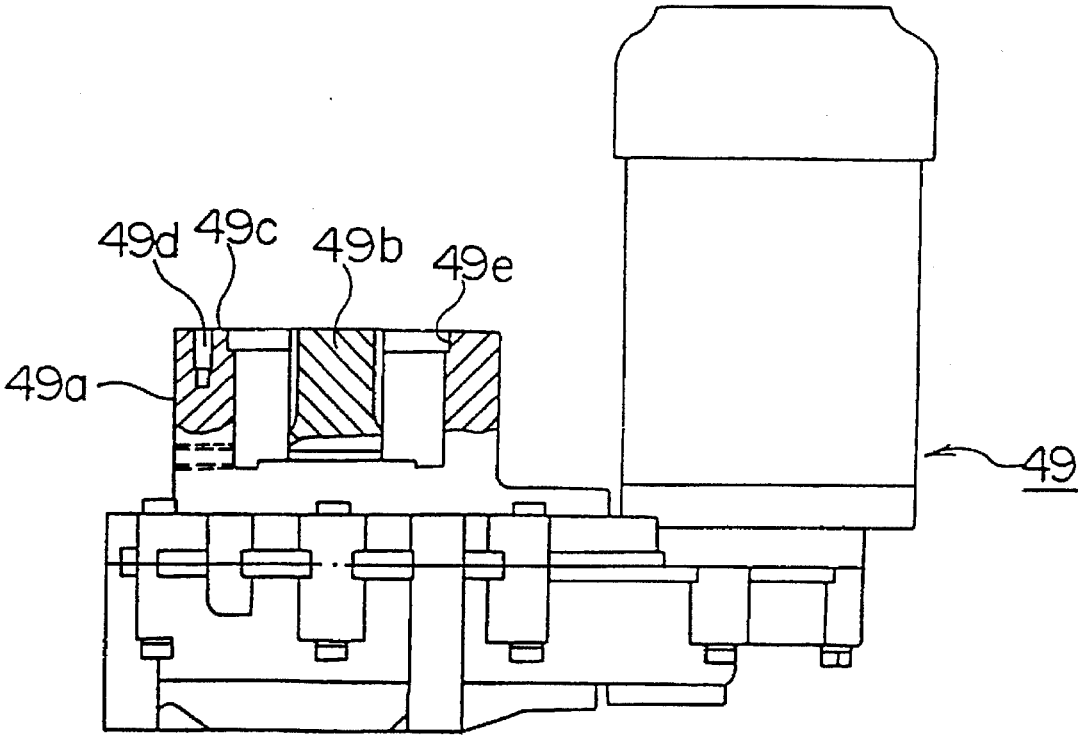
FIG. 3 is a partially cutaway front view showing a drive unit, which is illustrated in a discrete form, in the auger-type ice making machine of the first embodiment.

FIG. 3 gives a relatively detailed view of the essential part of the geared motor 49. The aforesaid output shaft 49*b* is connected in a widely-known manner to a rotor of the geared motor 49 via a gear train (not illustrated) and it is disposed coaxially in a substantially cylindrical opening of the casing 49*a*. A junction surface 49*c* is annularly formed to surround the opening and the output shaft 49*b* on the horizontal top surface of the casing 49*a*, a plurality of tapped holes 49*d* for the aforesaid flange bolts 51 being also provided on the aforesaid top surface. Further, on the inner side of the junction surface 49*c* in the radial direction, an annular fitting surface 49*e*, which extends axially, is formed in steps in the foregoing opening with high accuracy preferably for spigot-connection with the connecting flange 21*a* of the ice making barrel 21.

Figure 4:
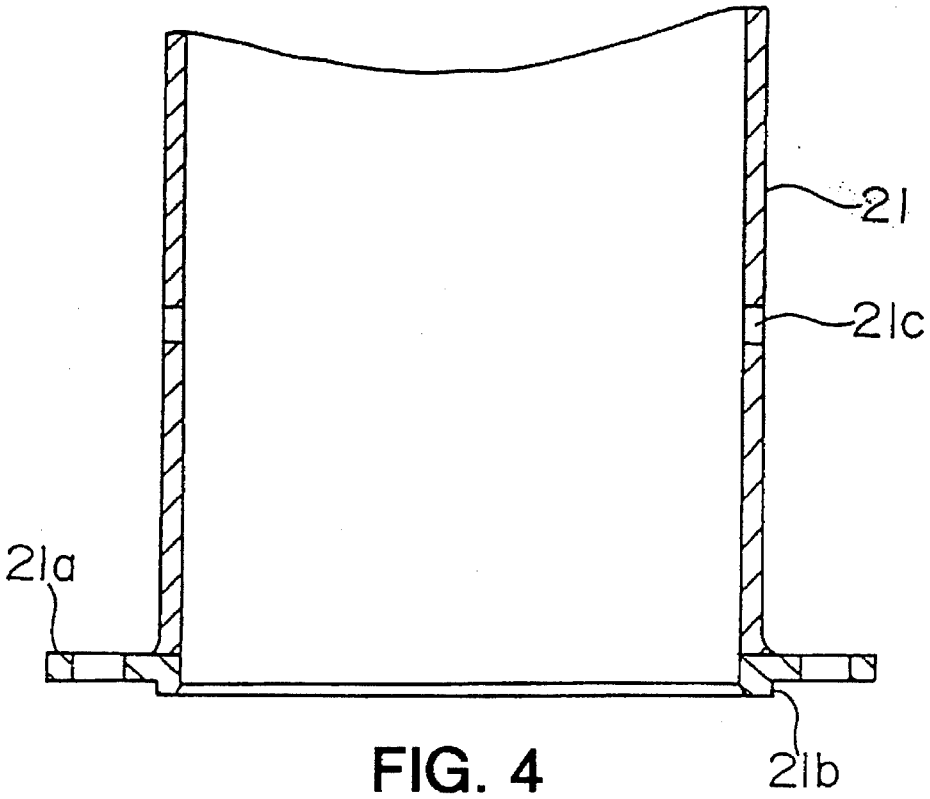
FIG. 4 is a partial cross-sectional view showing an essential part of the ice making barrel of the auger-type ice making machine of the first embodiment.

FIG. 4 shows the shape of the bottom section of the ice making barrel 21 which is spigot-connected with the casing 49*a* of the geared motor 49. The outside diameter of the body of the ice making barrel 21 significantly differs from that of the connecting flange 21*a*. Therefore, these two components are formed as one piece by friction welding, then only the inner and outer surfaces of the welded section are trimmed in order to reduce material costs and cutting operations. The friction welding strengthens the section where the body of the ice making barrel is bonded with the connecting flange 21*a* and it also permits accurate bonding. Furthermore, an annular projection 21*b*, which is spigot-connected in an appropriate manner with the stepped fitting surface 49*e* of the casing 49*a* of the geared motor 49, is formed at the bottom of the connecting flange 21*a* by cutting. Formed in the ice making barrel 21 are a required number of bolt holes 21*c* for bolts 39 for fixing the bearing housing 41, which terminates substantially above the connecting flange 21*a*, onto the ice making barrel 21.

Incidentally, important considerations for forming the ice making barrel and the flange into one piece include: (1) to minimize the distortion attributable to machining so as to minimize the finishing tolerance and also control the material cost and the machining cost to a minimum; (2) to ensure high strength of junction surfaces and controlled variations in strength; and (3) to minimize machining man-hours and material cost. To achieve the requirements listed above, the following methods are available to form the flange as an integral part of the ice making barrel:

(a) Method based on friction welding

Friction welding is designed to evenly heat a junction surface and the vicinity thereof to perform welding and therefore offers many advantages including less distortion caused by heating, high strength of a welded section (when a material such as SUS304 is used, the welded section does not break due to high tensile strength), fewer variations, straight securing with respect to the flange surface, and less welding and post-processing (finishing) man-hours.

(b) Method for forming a flange from one piece

A method based on spinning is designed to roll the flange and the entire ice making barrel from a thick-wall cylinder, thus making the flange an integral part of the ice making barrel. This method permits high strength and accuracy with less cost due to waste of material, leading to lower component cost.

Hence, a suited method may be adopted in accordance with facilities and other factors involved.

Figure 5:
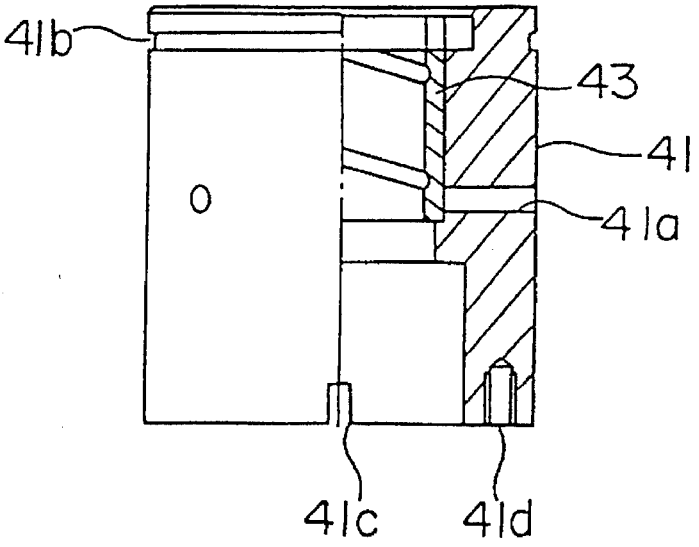
FIG. 5 is a partially cutaway front view showing a bearing housing and a bearing, which are illustrated in an isolated form, in the auger-type ice making machine of the first embodiment.

FIG. 5 is a detailed view of the bearing housing 41 fixed onto the ice making barrel 21 with the fixing bolts 39 as described above and the lower bearing 43 which is fitted in the bearing housing 41. The bearing housing 41 has a tapped hole 41*a* which is formed in the radial direction and into which the fixing bolt 39 is screwed, nearly at the axial center, a circumferential groove 41*b* for the O-ring 45 formed near the top end, and a positioning groove 41*c* and a tapped hole 41*d* for mounting a removable jig, which are formed in the axial direction, at the bottom end.

Figure 2:
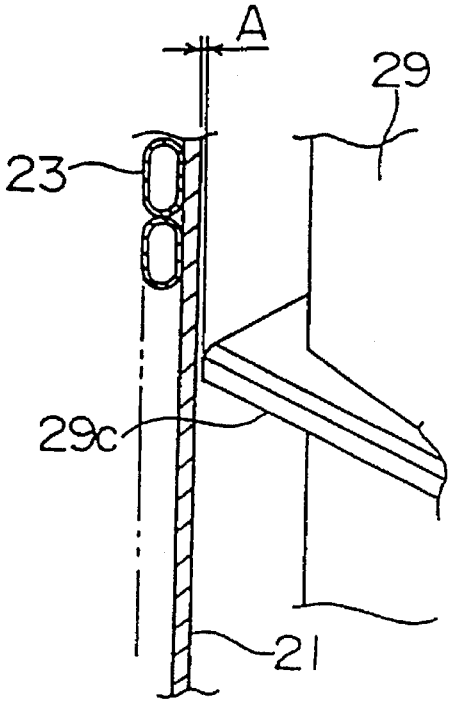
FIG. 2 is a partial enlarged view of an ice making barrel and an auger in the auger-type ice making machine shown in FIG. 1.

Thus, when the bearing housing 41 and the lower bearing 43 have been mounted onto the lower shaft 29*b* of the auger 29 so as to be installed at the bottom inside the ice making barrel 21, and the connecting flange 21*a* of the ice making barrel 21 has been connected to the junction surface 49*c* of the casing 49*a* of the geared motor 49 coaxially with the output shaft 49*b*, an appropriate gap A is formed between a spiral blade 29*c* of the auger 29 and the inner peripheral surface of the ice making barrel 21 as illustrated in FIG. 2.

In the construction described above, the ice making water, which is supplied into the ice making barrel 21 through the ice making water supply port 27, is cooled by the refrigerant flowing in the evaporating pipe 23 and grows as a layer of ice on the inner peripheral surface of the ice making barrel 21. The layer of ice is scraped by the spiral blade 29*c* of the auger 29 which is rotated by the output shaft 49*b* and fed upwardly to be pushed into the ice compressing passage (not shown) of the pressing head 33. The ice passes through the ice compressing passage while it is compressed. At this time, resistance from the ice passing through the passage and the scraping force are generated in the ice making barrel 21. This upward load is transmitted to the casing 49*a* of the geared motor 49 via the flange bolts 51. The forces are transmitted to the flange bolts 51 as axial tension rather than a bending force or shear stress. Hence, if any displacement results, it will be small enough to be ignored. Thus the vertical posture of the ice making barrel 21 can be properly maintained.

Figure 6:
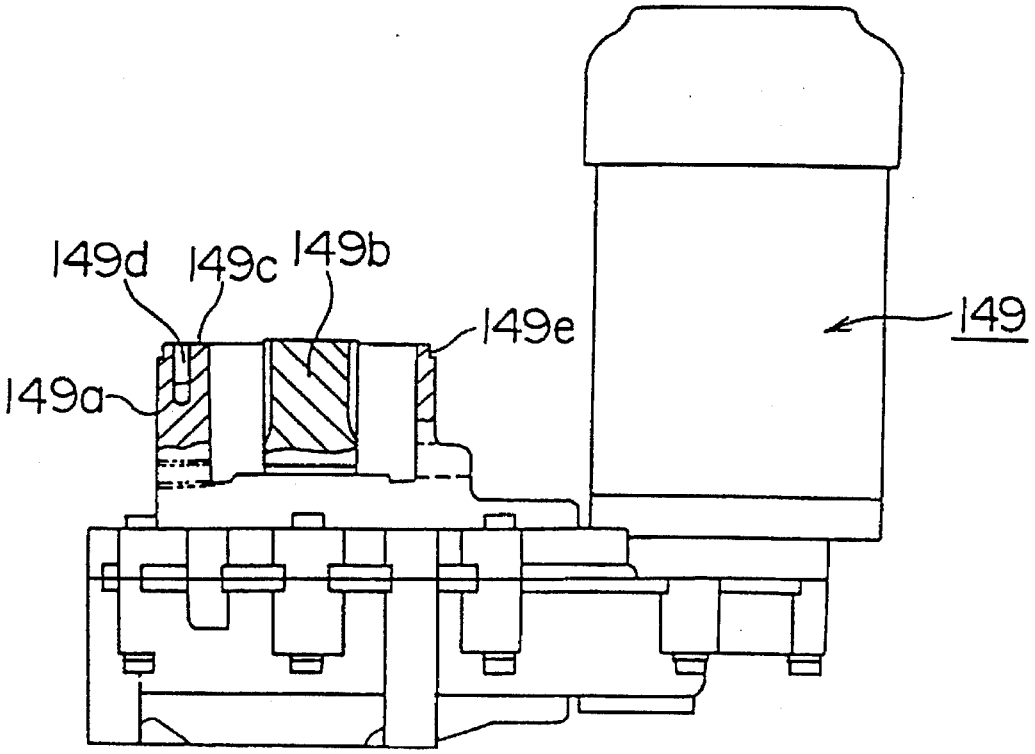
FIG. 6 is a partially cutaway front view showing the drive unit in a second embodiment.
Figure 7:
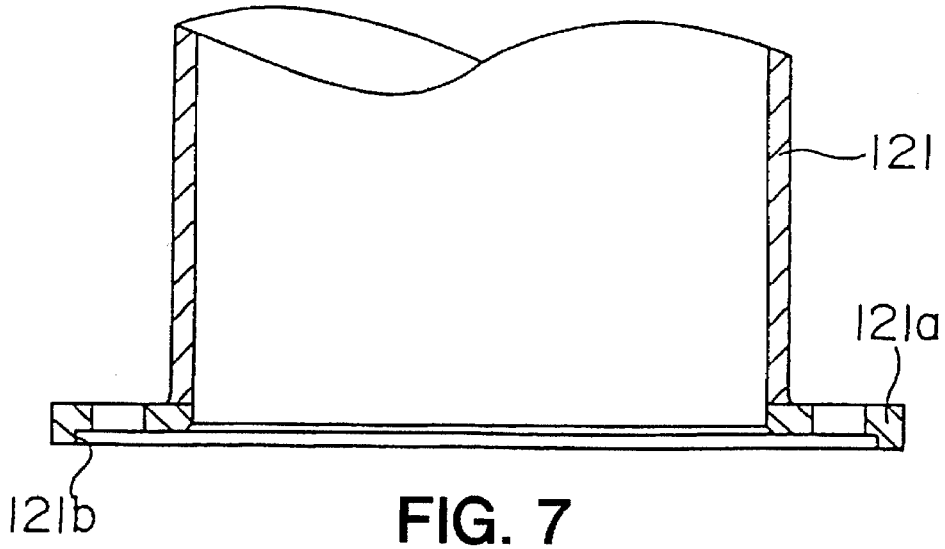
FIG. 7 is a partial cross-sectional view showing an essential part of the ice making barrel used in combination with the drive unit in the second embodiment.

In the embodiment described above, the fitting surface 49*e* of the casing 49*a* of the geared motor 49 is formed on the inside of the annular junction surface 49*c* in the radial direction. Alternatively, a fitting surface 149*e* may be formed on the outside of a junction surface 149*c* in the radial direction as shown in FIG. 6. In this case, the bottom end section of an ice making barrel 121, which is connected to a casing 149*a* of a geared motor 149, is formed as shown in FIG. 7. As seen from the drawing, an annular projection 121*b* is formed to extend downwardly on the outer edge of a junction flange 121*a* in the radial direction and the annular projection 121*b* is fitted into fitting surface 149*e* of the casing 149*a* of the geared motor 149 according to a proper fitting method, thereby maintaining the ice making barrel 121 coaxial with an output shaft 149*b*.

Figure 8:
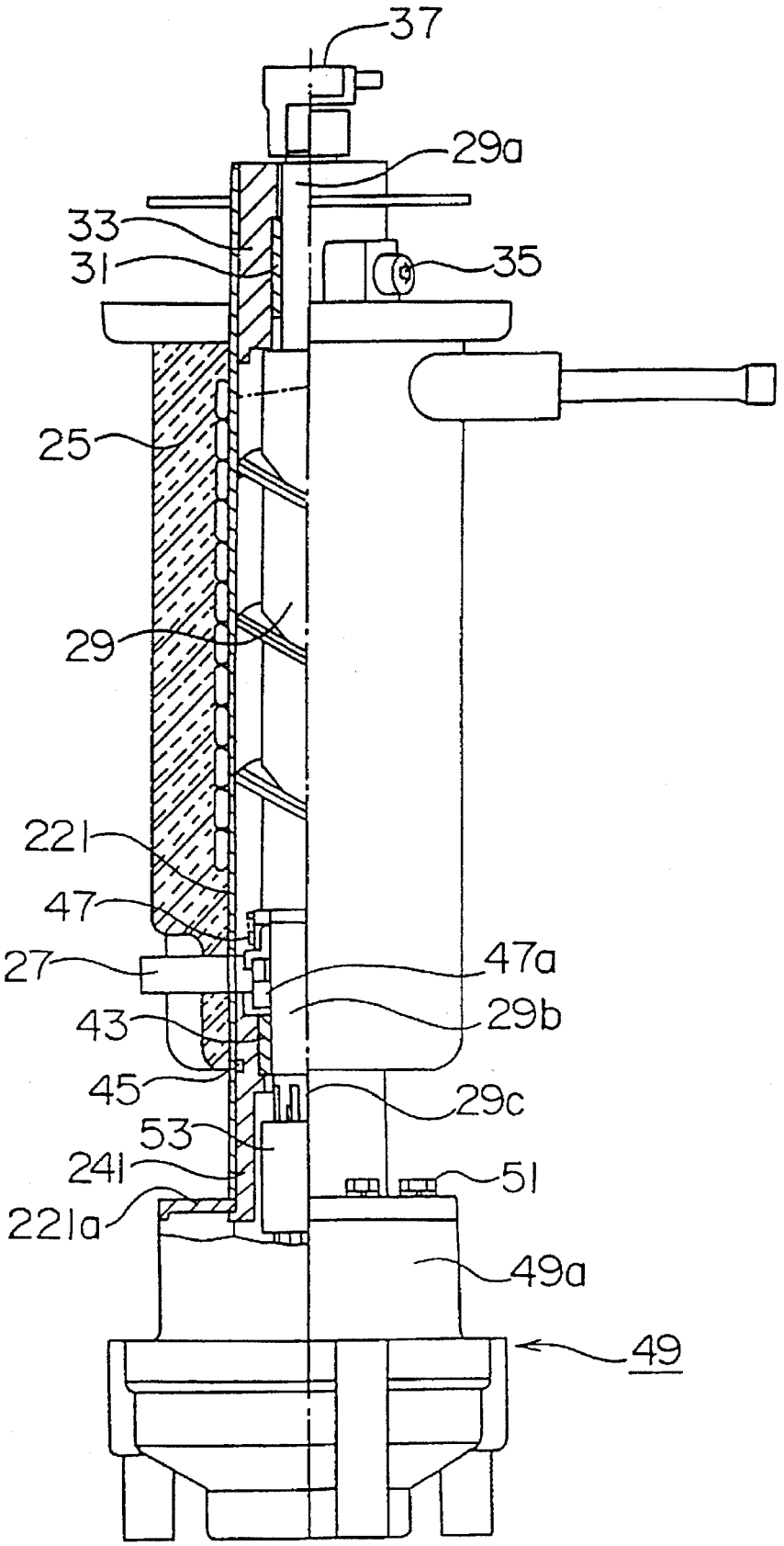
FIG. 8 is a partially cutaway front view showing an auger-type ice making machine of a third embodiment.

Further, in the embodiment shown in FIG. 1 to FIG. 5, the bearing housing 41 is fixed onto the ice making barrel 21 with bolts 39. The bearing housing 41, however, may alternatively be fixed by combining projections and a groove as illustrated in FIG. 8. In FIG. 8, a bearing housing 241 has its bottom end extended longer than in the aforesaid bearing housing 41, i.e. it extends as far as the bottom of a junction flange 221*a* of an ice making barrel 221 (the ice making barrel 221 has an annular projection as shown in FIG. 7 and the junction flange to be fitted thereto is also formed as shown in FIG. 6). Detailed views of the bearing housing 241 are given in FIGS. 9A and 9B. The rest of the construction is the same as that shown in FIG. 1, therefore, the same reference numerals will be given and the explanation thereof will be omitted.

Figure 9A:
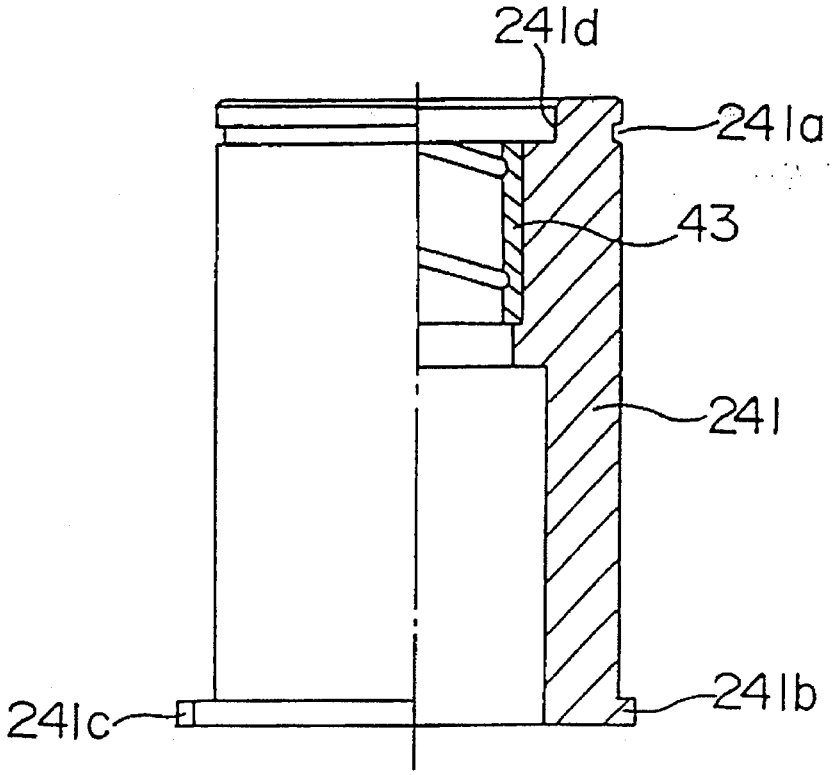
FIGS. 9A and 9B are a partially cutaway front view and a bottom plan view, respectively, showing a bearing housing and a bearing in the auger-type ice making machine of the third embodiment.
Figure 9B:
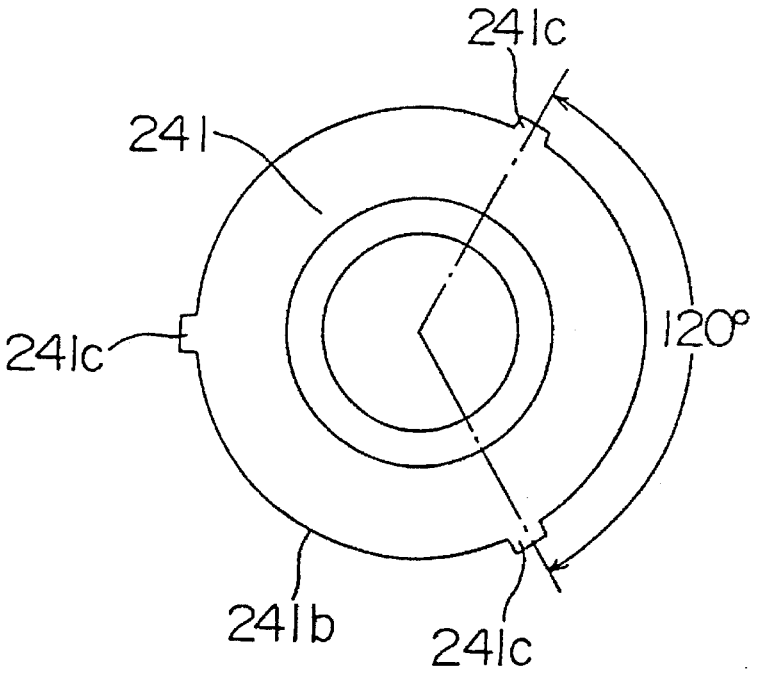

In FIGS. 9A and 9B, a lower bearing 43 is fitted inside the bearing housing 241. A circumferential groove 241*a* for the O-ring 45 (see FIG. 1) is formed in the top outer peripheral surface. The bearing housing 241 further has an outward flange 241*b* formed at the bottom end, three projections 241*c* formed at a 120-degree circumferential pitch on the outside in the radial direction (see FIG. 9B in particular), and a stepped section 241*d* for the mechanical seal 47 on the inside surface at the top. The mechanical seal 47 includes a floating sheet 47*a* as shown in FIG. 8, the details of which are disclosed in, for example, Japanese Utility Model Laid-Open No. 57-85169.

Figure 10:
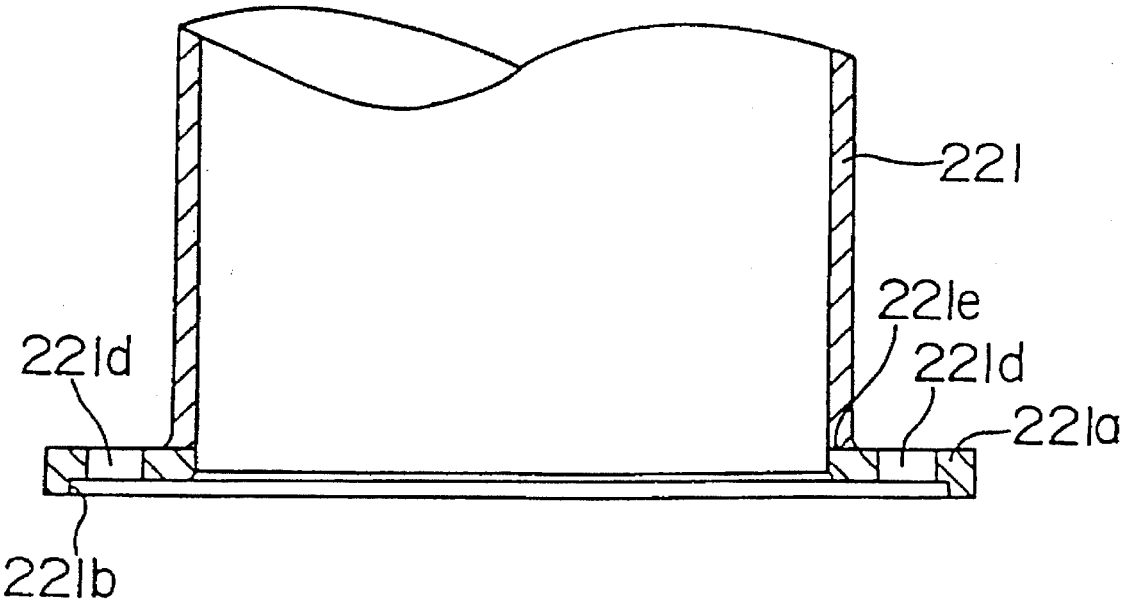
FIG. 10 is a partial cross-sectional view showing an essential part of the ice making barrel in the auger-type ice making machine of the third embodiment.

The ice making barrel 221 shown in FIG. 8 is identical to the above-mentioned ice making barrel 121 shown in FIG. 7 except that it has no holes for the bolts 39 for fixing the bearing housing. Referring to FIG. 10, the disc-shaped junction flange 221*a*, which is connected to the body of the ice making barrel 221 by friction welding at the part indicated by reference numeral 221*e*, has a plurality of bolt holes 221*d* for the flange bolts 51 provided apart from each other in the circumferential direction, and also has a fitting groove 221*b* at the bottom.

Figure 11A:
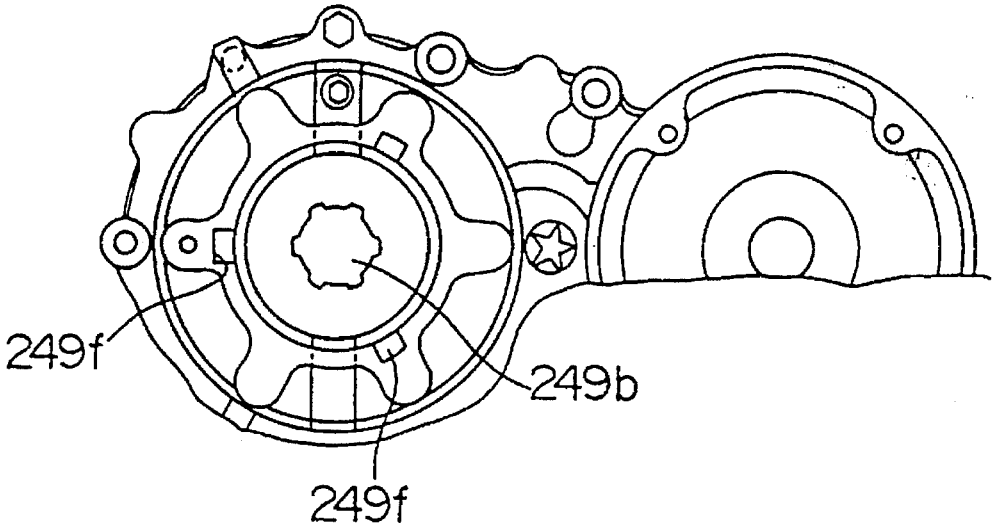
FIGS. 11A and 11B are a partial top plan view and a partially cutaway front view, respectively, showing the drive unit in the auger-type ice making machine of the third embodiment.
Figure 11B:
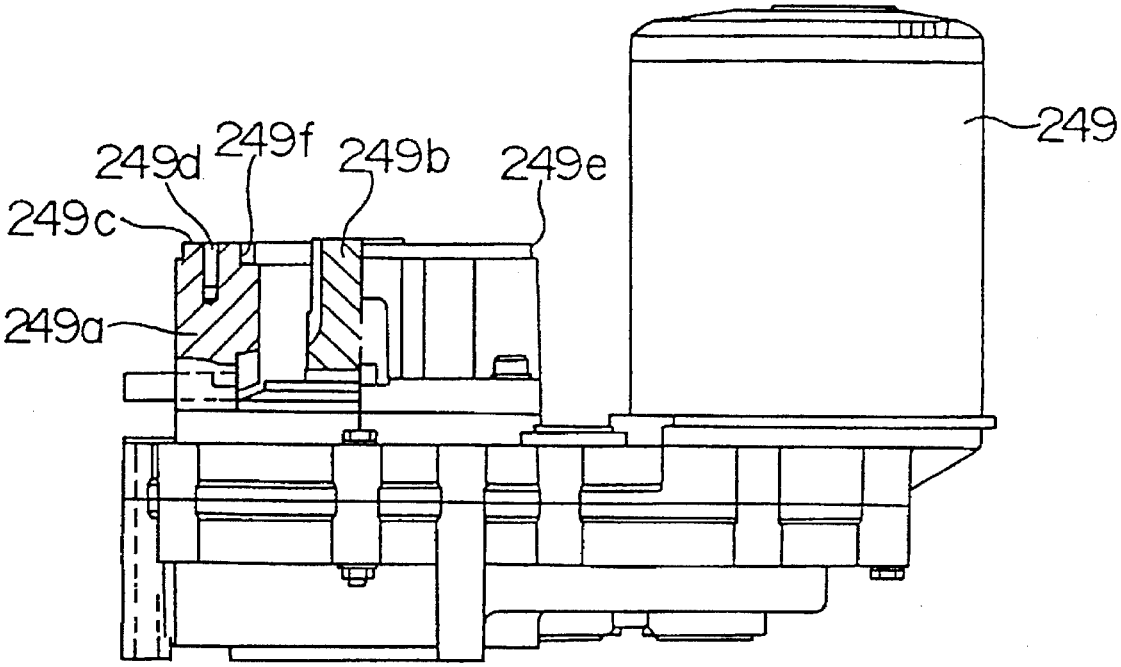
Figure 12:
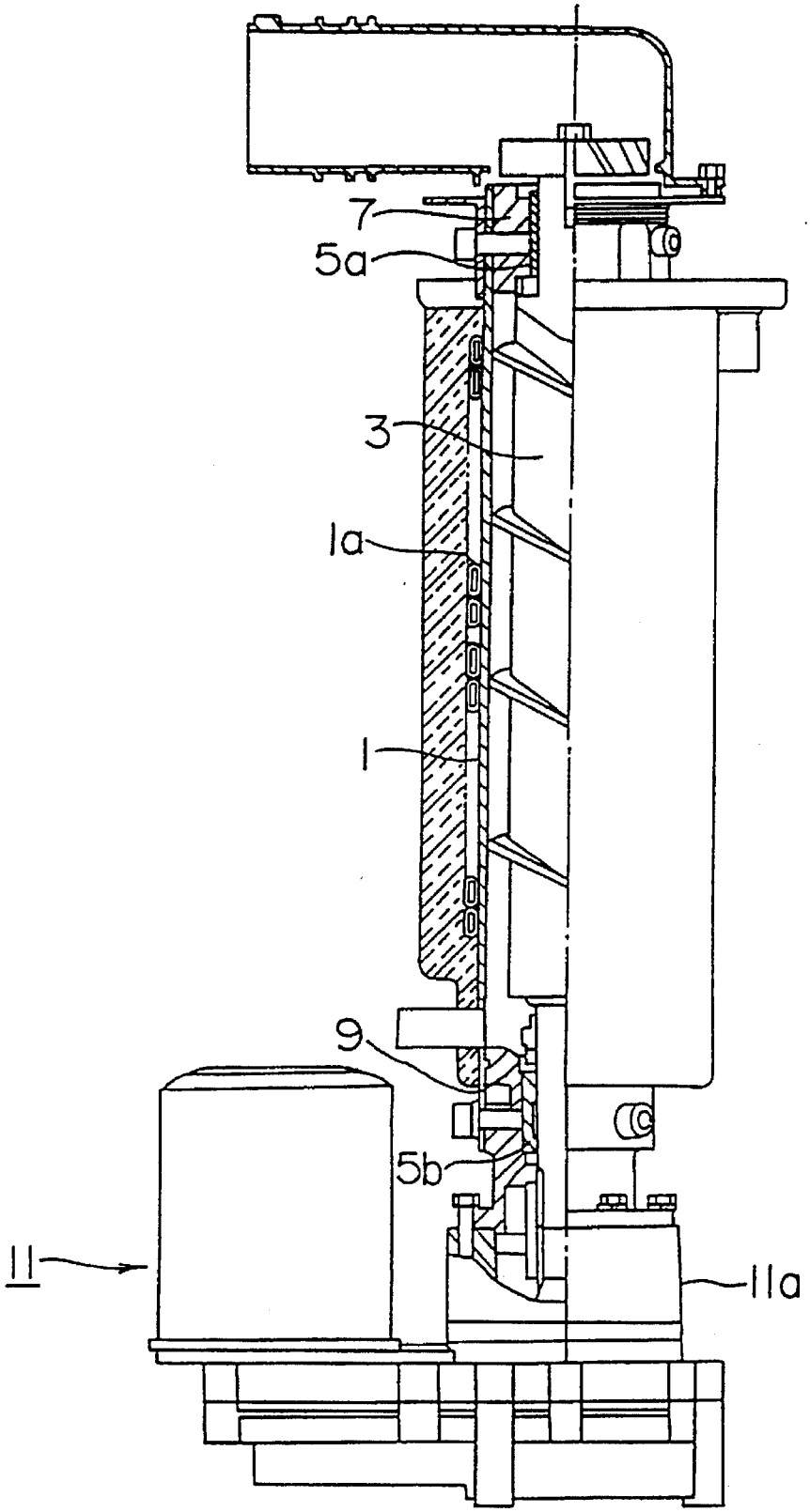
FIG. 12 PRIOR ART
FIG. 12 is a partially cutaway front view showing the entire structure of a conventional auger-type ice making machine.

A geared motor 249 to which is fitted the junction flange 221*a* of the ice making barrel 221 is shown in FIG. 11A and FIG. 11B. The geared motor 249 shares the same basic structure as that of the aforesaid geared motor 49. The geared motor 249 has a casing 249*a*, an output shaft 249*b*, a junction surface 249*c*, a tapped screw 249*d* for a flange bolt, a fitting surface 249*e* for spigot connection, and three slots 249*f* in which the projections 241*c* of the bearing housing 241 are inserted.

The ice making barrel 221, the bearing housing 241, and the geared motor 249 which have the constructions described above are assembled as illustrated in FIG. 8. They are functionally the same as the first embodiment, therefore, the explanation of the operation thereof will be omitted.

Thus, according to the present invention, since the connecting flange, which is integrally formed on the bottom end of the ice making barrel, is directly mounted on the casing of the drive unit, the number of the parts used is decreased and the accumulated tolerance is accordingly reduced. This leads to improved coaxially between the ice making barrel and the auger, allowing an ideal gap to be maintained between the spiral blade of the auger and the inner surface of the ice making barrel with consequent improved ice making performance. In addition, the service life of the bearing is prolonged since eccentric wear on the bearing is reduced due to decreased eccentric load applied when the spiral blade scrapes the ice.

Further, although the upward thrust load applied to the ice making barrel is transmitted to the flange bolts connecting the ice making barrel and the drive unit, the load is applied in the direction of the axial center of the flange bolts, therefore, the load does not cause the flange bolts to loosen. As a result, displacement or deformation of the ice making barrel, the bearing housing, etc. is substantially eliminated, allowing the optimal mounting posture of the ice making barrel to be maintained at all times.

The connecting flange formed on the ice making barrel is directly fixed on the casing of the drive unit. Therefore, the thrust load and radial load generated due to the scraping and transferring of the ice by the auger and the compression and dehydration carried out in the pressing head are borne by the ice making barrel. This means that the thrust load applied to the lower bearing housing fixed in the ice making barrel comes only from the spring pressure for maintaining the watertightness of the sliding section of the mechanical seal and the radial load turns into a compression load which is transmitted to the ice making barrel through the bearing housing. Further, since the lower bearing housing is fixed in the ice making barrel, the load applied to the unit area of the lower bearing housing can be reduced by increasing the contact area of the two. This enables a plastic molding to be employed for the lower bearing housing. By molding the bearing housing with the bearing inserted, only the inside diameter of the bearing has to be subjected to a cutting process, thus achieving better concentricity between the bearing surface and the outer peripheral surface of the bearing housing and also markedly reduced cost.

The spring pressure of the mechanical seal is the only thrust load applied to the lower bearing housing which has to be taken into account. The torque applied to the lower bearing housing is small due to the friction between the lower shaft of the auger and the bearing. Hence, the lower bearing housing will have sufficient durability even if it is fixed onto the ice making barrel with small screws or even if the lower bearing housing is provided with a flange at the bottom thereof to fix it by holding the flange thereof between the connecting flange of the ice making barrel and the casing of the drive unit. This permits the selection of an optimum fixing method for easier assembly according to the type of the geared motor constituting the drive unit and the shape of the ice making barrel.

What is claimed is:

1. An auger-type ice making machine comprising:

a vertically extending ice making barrel;

an auger disposed coaxially in said ice making barrel;

an upper bearing and a lower bearing provided in an upper section and a lower section, respectively, of said ice making barrel and supporting said auger rotatably within said ice making barrel;

a drive unit connected to a bottom end section of said auger for rotating said auger;

a casing covering said drive unit; and a connecting flange extending radially outwardly from a bottom end of said ice making barrel, said connecting flange being formed integrally with said ice making barrel by friction welding therebetween, said connecting flange being tightened onto a top surface of said casing by bolts.

2. An auger-type ice making machine according to claim 1, wherein said connecting flange has a radially inner surface that is substantially axially aligned with an inner cylindrical ice making surface of said ice making barrel.

3. An auger-type ice making machine according to claim 1, wherein said casing has an annular horizontal junction surface which is in contact with a horizontal bottom surface of said connection flange and an annular stepped surface which is formed on said junction surface, and said connecting flange has an annular projection which fits in said annular stepped surface of said casing.

4. An auger-type ice making machine according to claim 3, wherein said annular stepped surface of said casing is formed along an inner periphery of said annular junction surface.

5. An auger-type ice making machine according to claim 4, wherein said annular projection has a radially inner surface that is substantially axially aligned with an inner cylindrical ice making surface of said ice making barrel.

6. Artauger-type ice making machine according to claim 3, wherein said annular stepped surface of said casing is formed along an outer periphery of said annular junction surface.

7. Artauger-type ice making machine according to claim 1, further comprising a bearing housing in which said lower bearing is fitted, said bearing housing being a structure separate from said connecting flange.

8. An auger-type ice making machine according to claim 7, wherein said bearing housing is fixed within said ice making barrel by a fixing bolt extending inwardly through said ice making barrel.

9. An auger-type ice making machine according to claim 8, wherein said bearing housing has a lower end spaced above said casing.

10. An auger-type ice making machine according to claim 8, wherein said bearing housing has a bottom end having extending radially outwardly therefrom a flange and a plurality of projections extending further radially outwardly from said flange, said plurality of projections being fitted into a groove formed in a top of said casing, thereby fixing said bearing housing.

* * * * *